United States Patent [19]

Hawkins et al.

[11] Patent Number: 4,988,016

[45] Date of Patent: Jan. 29, 1991

[54] SELF-SEALING CONTAINER

[75] Inventors: James P. Hawkins, 6848 Draper, LaJolla, Calif. 92037; Hassan Aref, Solana Beach, Calif.

[73] Assignee: James P. Hawkins, LaJolla, Calif.

[21] Appl. No.: 303,891

[22] Filed: Jan. 30, 1989

[51] Int. Cl.[5] ..... B65D 37/00

[52] U.S. Cl. ..... 222/92; 222/107; 222/494

[58] Field of Search ..... 222/91, 107, 541, 494, 222/213, 498

[56] References Cited

U.S. PATENT DOCUMENTS

| | | |
|---|---|---|
| 24,251 | 12/1956 | Kaplan et al. . |
| 2,309,895 | 2/1943 | Griffith . |
| 2,364,307 | 12/1944 | Mossett . |
| 2,430,995 | 11/1947 | Roos . |
| 2,437,693 | 3/1948 | Hartman . |
| 2,517,027 | 8/1950 | Rado . |
| 2,517,068 | 8/1950 | Weeks . |
| 2,546,709 | 3/1951 | Abarr . |
| 2,663,461 | 12/1953 | Brown . |
| 2,696,342 | 12/1954 | Toborg . |
| 2,707,581 | 5/1955 | Kaplan . |
| 2,753,091 | 7/1956 | Herzig . |
| 2,799,314 | 7/1957 | Dreyer et al. . |
| 2,815,150 | 12/1957 | Herzig . |
| 2,904,225 | 9/1959 | Earles, Jr. . |
| 2,947,448 | 8/1960 | Maddux . |
| 3,009,498 | 11/1961 | Fohr . |
| 3,012,698 | 12/1961 | Wiederquist et al. . |
| 3,063,601 | 11/1962 | Hertz . |
| 3,072,304 | 1/1963 | Junaid . |
| 3,087,670 | 4/1963 | Rhodes . |
| 3,121,578 | 2/1964 | Moses ..... 222/494 |
| 3,131,836 | 5/1964 | VanBaarn . |
| 3,137,419 | 6/1964 | Davy . |
| 3,144,197 | 8/1964 | Milner et al. . |
| 3,179,301 | 4/1965 | Lucht . |
| 3,184,121 | 5/1965 | Volckening . |
| 3,187,984 | 6/1965 | Hollis et al. . |
| 3,203,623 | 8/1965 | Hartig . |
| 3,207,420 | 9/1965 | Navarrete-Kindelan . |
| 3,215,319 | 11/1965 | Laker . |
| 3,235,169 | 2/1966 | Gennerich et al. . |
| 3,236,438 | 2/1966 | Rhodes . |
| 3,244,332 | 4/1966 | Rogers . |
| 3,263,903 | 8/1966 | Waller et al. . |
| 3,266,711 | 8/1966 | Song . |
| 3,278,085 | 10/1966 | Brown . |
| 3,281,060 | 10/1966 | Heimos et al. . |
| 3,315,849 | 4/1967 | Herzig . |
| 3,384,294 | 5/1968 | Astle . |
| 3,386,503 | 6/1968 | Corning et al. . |
| 3,426,629 | 2/1969 | Herzig et al. . |
| 3,441,199 | 4/1969 | Brockmuller . |
| 3,451,120 | 6/1969 | Herzig et al. . |
| 3,463,357 | 8/1969 | MacLean, Jr. et al. . |
| 3,469,478 | 9/1969 | Herzig et al. . |
| 3,601,252 | 8/1971 | Sager . |

(List continued on next page.)

*Primary Examiner*—H. Grant Skaggs

*Attorney, Agent, or Firm*—Knobbe, Martens, Olson & Bear

[57] ABSTRACT

A container for fluids is disclosed in which the container is comprised of two flexible sheets joined so as to form a fluid reservoir. Leading from the reservoir is an exit flow channel to permit the expulsion of the fluid contents when pressure is applied to the container. When the applied pressure falls below a predetermined critical value, the exit flow channel will automatically self-seal, thus preventing further fluid flow, leakage, or spoilage. This self-sealing is achieved so long as the exit channel exhibits characteristics of width and length which are proportional to certain dimensionless parameters which are, in turn, proportional to several specific parameters which are dependent on the fluid, material of the container, and the desired context in which the container is intended for use. Thus, self-sealing can be achieved by an exit flow channel which is independent of its path (i.e., the course it follows), thus permitting great flexibility in container and exit flow channel design. The present invention also encompasses a method for determining the width and length of the channel, utilizing the mathematical relationships between said dimensionless parameters.

1 Claim, 2 Drawing Sheets

U.S. PATENT DOCUMENTS

| | | | |
|---|---|---|---|
| 3,610,477 | 10/1971 | Herzig . | |
| 3,635,376 | 1/1972 | Hellstrom . | |
| 3,645,423 | 2/1972 | DeGraw . | |
| 3,651,995 | 3/1972 | Chaney . | |
| 3,674,183 | 7/1972 | Venable et al. . | |
| 3,685,701 | 8/1972 | Kollus . | |
| 3,711,011 | 1/1973 | Kugler . | |
| 3,746,246 | 7/1973 | Murray . | |
| 3,750,907 | 8/1973 | Steele . | |
| 3,815,794 | 6/1974 | Carlisle . | |
| 3,825,157 | 7/1974 | Herzig . | |
| 3,862,684 | 1/1975 | Schmitt . | |
| 3,878,977 | 4/1975 | Carlisle . | |
| 3,894,683 | 7/1975 | Henderson . | |
| 3,897,003 | 2/1974 | Zehr . | |
| 3,937,371 | 2/1976 | Del Bon . | |
| 3,943,682 | 3/1976 | Rausing . | |
| 3,990,628 | 11/1976 | Van den Beld et al. . | |
| 4,054,232 | 10/1977 | Cawley . | |
| 4,069,951 | 1/1978 | von Winckelmann . | |
| 4,069,964 | 1/1978 | Willet et al. . | |
| 4,071,187 | 1/1978 | LaFluer . | |
| 4,111,354 | 9/1978 | Brunker . | |
| 4,124,150 | 11/1978 | Moss . | |
| 4,148,420 | 4/1979 | Morrissette et al. . | |
| 4,171,755 | 10/1979 | Carlisle . | |
| 4,196,030 | 4/1980 | Ausnit . | |
| 4,252,257 | 2/1981 | Herzig . | |
| 4,258,876 | 3/1981 | Ljungcrantz . | |
| 4,275,840 | 6/1981 | Staar . | |
| 4,301,939 | 11/1981 | Pupp . | |
| 4,328,912 | 5/1982 | Haggar, deceased et al. . | |
| 4,331,264 | 5/1982 | Staar . | |
| 4,335,815 | 6/1982 | Babiol et al. . | |
| 4,411,376 | 10/1983 | Bennett et al. . | |
| 4,412,645 | 11/1983 | Lepisto . | |
| 4,441,209 | 4/1984 | Lunshof et al. . | |
| 4,464,154 | 8/1984 | Ljungcrantz . | |
| 4,491,245 | 1/1985 | Jamison . | |
| 4,526,296 | 7/1985 | Berger et al. | 222/107 |
| 4,564,139 | 1/1986 | Reil . | |
| 4,592,493 | 6/1986 | Smith . | |
| 4,604,850 | 8/1986 | Reil . | |
| 4,620,648 | 11/1986 | Schwartzman . | |
| 4,629,080 | 12/1986 | Carveth . | |
| 4,706,874 | 11/1987 | Reil . | |
| 4,708,705 | 11/1987 | Aubry et al. . | |
| 4,709,836 | 12/1987 | Andersen . | |
| 4,715,528 | 12/1987 | Kjelgaard et al. . | |
| 4,717,046 | 1/1988 | Brogli . | |
| 4,792,060 | 12/1988 | Brogli . | |

FOREIGN PATENT DOCUMENTS

| | | |
|---|---|---|
| 145452 | 11/1982 | Denmark . |
| 115990 | 1/1984 | European Pat. Off. . |
| 210428 | 6/1986 | European Pat. Off. . |
| 3143671 | 5/1983 | Fed. Rep. of Germany . |
| 29504 | 6/1958 | Finland . |
| 58-16774 | 4/1983 | Japan . |
| 58-22925 | 5/1983 | Japan . |
| 58-37827 | 8/1983 | Japan . |
| 58-42285 | 9/1983 | Japan . |
| 58-17135 | 10/1983 | Japan . |
| 58-54364 | 12/1983 | Japan . |
| 58-56189 | 12/1983 | Japan . |
| 59-397 | 2/1984 | Japan . |
| 59-4930 | 2/1984 | Japan . |
| 59-93655 | 5/1984 | Japan . |
| 59-89841 | 6/1984 | Japan . |
| 59-89842 | 6/1984 | Japan . |
| 59-24674 | 7/1984 | Japan . |
| 118748 | 8/1984 | Japan . |
| 150740 | 10/1984 | Japan . |
| 150741 | 10/1984 | Japan . |
| 60-10942 | 3/1985 | Japan . |
| 60-38236 | 3/1985 | Japan . |
| 60-15544 | 4/1985 | Japan . |
| 60-68036 | 5/1985 | Japan . |
| 60-3172 | 7/1985 | Japan . |
| 101441 | 7/1985 | Japan . |
| 139733 | 9/1985 | Japan . |
| 60-55377 | 12/1985 | Japan . |
| 182344 | 12/1985 | Japan . |
| 61-27859 | 2/1986 | Japan . |
| 61-35150 | 3/1986 | Japan . |
| 105643 | 7/1986 | Japan . |
| 107741 | 7/1986 | Japan . |
| 61-28779 | 8/1986 | Japan . |
| 134944 | 8/1986 | Japan . |
| 137568 | 8/1986 | Japan . |
| 62-1087 | 1/1987 | Japan . |
| 62-1088 | 1/1987 | Japan . |
| 62-25646 | 2/1987 | Japan . |
| 62-28349 | 2/1987 | Japan . |
| 62-31056 | 2/1987 | Japan . |
| 62-42560 | 3/1987 | Japan . |
| 638606 | 3/1987 | Japan . |
| 62-17419 | 5/1987 | Japan . |
| 62-93040 | 6/1987 | Japan . |
| 62-99534 | 6/1987 | Japan . |
| 118042 | 7/1987 | Japan . |
| 62-40184 | 8/1987 | Japan . |

SELF-SEALING CONTAINER

BACKGROUND OF THE INVENTION

The present invention relates to self-sealing containers, and, more particularly, to containers constructed from two deformable sheets of material sealed together on all four sides to form a reservoir for containing fluid. The container is provided with an exit flow channel which leads from the reservoir to a terminal point near one of the sealed sides of the container. The fluid can be accessed by tearing or cutting the sealed edge to expose an orifice in the channel and by applying pressure to the container to expel its contents Once the pressure on the container is released, the exit flow channel seals itself automatically to prevent further egress of fluid.

Containers of all shapes, sizes and materials are extremely prevalent in our society. This is particularly true for packaging used to contain a variety of fluids, such as beverages, medicines, chemicals, etc. It is a consistent desire of manufacturers to reduce the cost of the container, which oftentimes exceeds the cost of its contents. Reusable containers are usually deemed to be cost prohibitive because of the cost of recycling or resterilization. Thus, there is a tendency for manufacturers to prefer disposable containers, not only for cost reasons, but also for health and safety reasons.

One type of disposable container, which is inexpensive to manufacture, takes the form of a pouch formed by two flexible sheets of material formed together around the periphery. The user simply tears or cuts one side of the pouch to access an exit flow channel, and the contents are expelled by manual pressure. Such flexible pouches are common for single-serving fluids such as condiments. However, for multiple-use fluids, such as beverages, these types of pouches are generally undesirable because of their inability to reseal at the exit flow channel once it is opened by the user. Thus, some manufacturers have attempted to produce flexible pouches which have sufficient rigidity or structure to permit them to stand erect in order to avoid spills or leakage. However, such additional features increase the cost of these types of packages. Other manufacturers have attempted to provide means for resealing the exit flow channel by providing various mechanical sealing elements (such as a duckbill valve) which bias the lips of the exit flow channel together to retain the fluid inside. Again, these additional features increase the cost of the packaging and have largely proven unsuccessful.

It has been suggested that the cost of such flexible packages can be greatly reduced by providing an exit flow channel which is automatically self-sealing. In other words, as soon as the expulsion pressure acting on the container is released or sufficiently reduced, the exit flow channel will automatically self-seal in order to prevent further fluid flow out of the package. Thus, leakage, spills or spoilage of the package contents can be avoided. This automatic self-sealing would obviously be a significant advantage in both single-use and multiple-use packages.

Previous attempts to produce a self-sealing exit flow channel have largely not been successful, especially in packaging which has actually been introduced in the commercial context. Essentially, previous manufacturers of such flexible packaging have attempted to design exit flow channels having a particular path geometry in order to accomplish self-sealing. In particular, the path geometry has been quite tortuous, consisting of channels which have, for example, S-shaped or hair pin turns. Other channels turn back toward the pouch reservoir or fold back on themselves in a Z-fold fashion. In other words, previously, it was thought that self-sealing was virtually wholly dependent on the shape of the path followed by the exit flow channel.

Not only was this design concept largely unsuccessful, but it also introduced many limitations in the applications in which such packages could exist. For example, with this previous approach, the orientation or direction of the exit flow channel could not be varied according to the specific use of the contents of the package. The exit flow channel would follow the same path whether the package contained a beverage, which would be consumed, or an industrial chemical, which might be applied to a machine. Furthermore, the orientation of the container (for example, in an upside down or sideways fashion) could not be varied to facilitate its use. Moreover, even if a self-seal could be accomplished, there was no flexibility in the design of previous containers to vary the flow rate of the fluid.

Thus, there has not been demonstrated in the prior art a complete understanding of the fluid dynamics associated with such containers having deformable sides, and, in particular, of the parametrical relationships in such self-sealing arrangements.

SUMMARY OF THE INVENTION

The present invention satisfies the need in the prior art for an automatically self-sealing, flexible-sided container by providing an exit flow channel which is independent of the path of the channel. Rather, the ability of the channel to self-seal, after achieving the desired fluid flow rate for a specified applied pressure range, depends solely upon the width and length dimensions of the channel and the relationship between those dimensions and certain parameters specific to the container material, the fluid contained therein, and the desired pressure flow rate conditions to which the container is subjected.

The present container is comprised of a pouch-like reservoir of fluid which is expelled through an exit flow channel when pressure is applied to the container. The overall shape (i.e., the path) of the exit flow channel of the present invention can vary widely according to the intended application or use of the contents, and the channel will still self-seal so long as its width and length are proportional to certain parametrical relationships exhibited by the material from which the container is formed and its fluid contents. Such self-sealing will be accomplished when the pressure applied to the container is below a certain, predetermined critical pressure. In other words, unlike the seals of the prior art, the ability of the exit flow channel of the present invention to self-seal is independent of the path of the channel, except to the extent that the channel's path determines its length.

In order to accomplish this flexibility in exit flow channel design, the present invention takes a global approach in that it considers all relevant parameters associated with self-sealing. In order to facilitate the analysis of many parameters, they have been combined into three "multiparameters," which are simply ratios and relationships of groups of parameters. These multiparameters are dimensionless, i.e., their value is independent of the units of the individual parameters of which they are comprised. By the use of these dimensionless multiparameters, the essentials of the design of the container of the present invention and its performance under scaling are revealed in a particularly clear and transparent form. The prior art is not based upon this global understanding. The present invention also comprises a unique method for determining the width and length of an exit flow channel which will achieve self-sealing according to the desired application for the contents of the container.

In a preferred embodiment, the container of the present invention is comprised of two flexible sheets of material of suitable strength which are superimposed one upon the other and mechanically sealed along all four edges to form a fluid reservoir. The mechanical sealing can be accomplished by any suitable means, such as heat sealing, etc. Leading from the reservoir is an exit flow channel which terminates at the boundary seal, very near to the outer edge of the container. The contents of the container can be expelled by cutting or tearing the boundary seal to expose an orifice of the exit flow channel to ambient air and pressure. Pressure is then applied, either manually or mechanically, to the sides of the container to force its contents out through the exit flow channel.

Since the container originates as two flat sheets of material (or a single sheet folded over to form a two-ply structure), the exit flow channel is also essentially flat in its relaxed state. However, when pressure is applied to the container, fluid is forced through the channel which enlarges to take on a cross-sectional shape which is approximately that of an ellipse. Thus, the shape and size of the ellipse is proportional to the amount of pressure being applied to the container, and the elliptical cross-section becomes more and more circular with increasing pressure. In order to analyze the parameters involved in self-sealing, the exit flow channel is itself a deformable boundary which will vary in a manner proportional to many other fluid and material parameters. By carefully considering these parameters, the exit flow channel self-seals automatically upon release or decrease in the applied pressure, so that the pressure differential between the exit orifice and the ambient air is below a predetermined level.

This self-sealing is accomplished in the present invention by the construction of an exit flow channel having a width and length in accordance with the parametrical relationships exhibited by the fluid, the material from which the container is constructed (and particularly the elasticity of the section of the container which is adjacent the exit flow channel), the desired exit flow rate of the contents, and the applied pressure differential. In designing the width and length of the channel, there are many trade-offs involved in these parametrical relationships. For example, if the container material is very stiff and tends to maintain its elliptical shape, it will be very difficult to accomplish self-sealing. Likewise, if the contents are to be expelled at very low applied pressures, then the pressure at which self-sealing will be accomplished will likewise be low, thus making it more likely to leak. Furthermore, if the application demands a high fluid flow rate at relatively low pressures, then the width of the channel would have to be correspondingly increased.

In addition to these and many other trade-offs, there are simply many parameters to be considered. The fluid parameters are very important in the self-sealing analysis. The surface tension ($\sigma$), the wetting angle ($\alpha$), and the viscosity ($\eta$) are all important fluid-related parameters. The material from which the container is constructed also introduces an important parameter, which is the elasticity along the exit flow channel (k). This elasticity is demonstrated by the material's tendency to restore its relaxed, essentially flat shape. Also, the length (L) and width (W) of the exit flow channel are important parameters, as discussed above.

As the cross-section of the channel takes on an essentially elliptical shape, the eccentricity of the ellipse becomes a key parameter in terms of which the flow behavior of the exit flow channel may be parametrized. Obviously, the applied pressure differential ($\Delta p$) between the exit orifice and the outside, ambient pressure is an essential parameter, together with the critical pressure differential ($\Delta p_c$) below which the channel accomplishes self-sealing. Finally, the desired flow rate (Q) is an important parameter which must be considered in the design of the container and, in particular, its exit flow channel.

Although other parameters may affect self-sealing, it is believed that the above parameters are most important in designing the width and length of a functioning self-seal. These parameters have not been adequately considered in previous flexible containers. Furthermore, the grouping of these parameters into dimensionless combinations displays the parametric dependencies at a hitherto unappreciated level of detail. The values of some of the physical parameters are dictated by the application. The values of other parameters can be easily looked up in tables which are readily available in the literature. Other parameters must be measured in a given context.

Embodied in the container of the present invention is the discovery that there are certain definite relationships exhibited by these specific parameters, which relationships themselves can be parametrized to facilitate the design of the exit flow channel, at least to the extent of its length and width. These relationships comprise ratios or combinations of the above parameters which simplify the design for the length and width of the exit flow channel. These combinations of parameters or "multiparameters" are briefly described below.

A "sealing parameter" involves the relationship between the specific fluid parameters and the deformable boundary (i.e., the exit flow channel) in which it flows. The sealing parameter also expresses, in one sense, the capillarity of the fluid in the exit flow channel and is most critical in determining the "crossover" point of the differential pressure where the channel ceases permitting fluid flow and seals itself.

The second multiparameter is the "pressure parameter," which expresses the relationship between the critical pressure below which self-sealing occurs, and the elasticity of the material surrounding the exit flow channel (k). This parameter is typically given by the design or application for the container and is used to directly determine the width (W). The third multiparameter is the "flow rate parameter," which expresses the desired flow rate in terms of several other parameters.

These combinations of parameters are dimensionless. They can be easily quantified, and their use simplifies the parametrical analysis in a complex fluid mechanics problem presented by self-sealing, deformable channels. It has been found that, even though individual parameters may vary, if the ratios of certain parameters do not vary, sealing can be achieved. Thus, changes in one parameter do not drastically affect the design or the ability of the exit flow channel to self-seal. The use of these multiparameters facilitates the consideration of the many trade-offs and sealing-related parameters, while permitting the width and length of the exit flow channel to be determined.

The method of the present invention involves the process of determining channel width and length, given specific data on critical pressure differential, package material and desired flow rate. The mathematical relationships between the three multiparameters discussed above can be tabulated for easy reference. The pressure parameter can be determined by the application for the container. In turn, the channel width can be calculated using the sealing parameter, and the channel length can be calculated using the flow rate parameter.

Although there is tremendous flexibility in exit flow channel design by utilizing the principles of the present invention, certain assumptions have been made. For example, it has been assumed that the fluid is "Newtonian" in that it exhibits an ordinary viscosity and does not retain its shape when the applied pressure is removed. Also, the fluid flow is presumed to be fully developed, laminar within some segment of the exit flow channel. It is also presumed that the fluid "wets" the inner surface of the container material; that is, the wetting angle ($\alpha$) is less than 90°. It is considered unimportant to achieve self-sealing whether or not air enters the pouch during use since the total pressure differential at the exit orifice is one of the parameters included in the overall analysis encompassed by the multiparameters.

Furthermore, as pointed out above, it is the width and length of the channel which is relevant to its ability to self-seal, rather than the path that the channel follows. Thus, the channel may be straight, or may have bends or curves, and self-sealing will still be achieved so long as the requisite length is present in the design. Small, and rather standard, empirical corrections may be employed to take into consideration the effects of bends in the channel, but these are not considered essential to the mechanisms described herein.

DETAILED DESCRIPTION OF THE INVENTION

Figure 1:
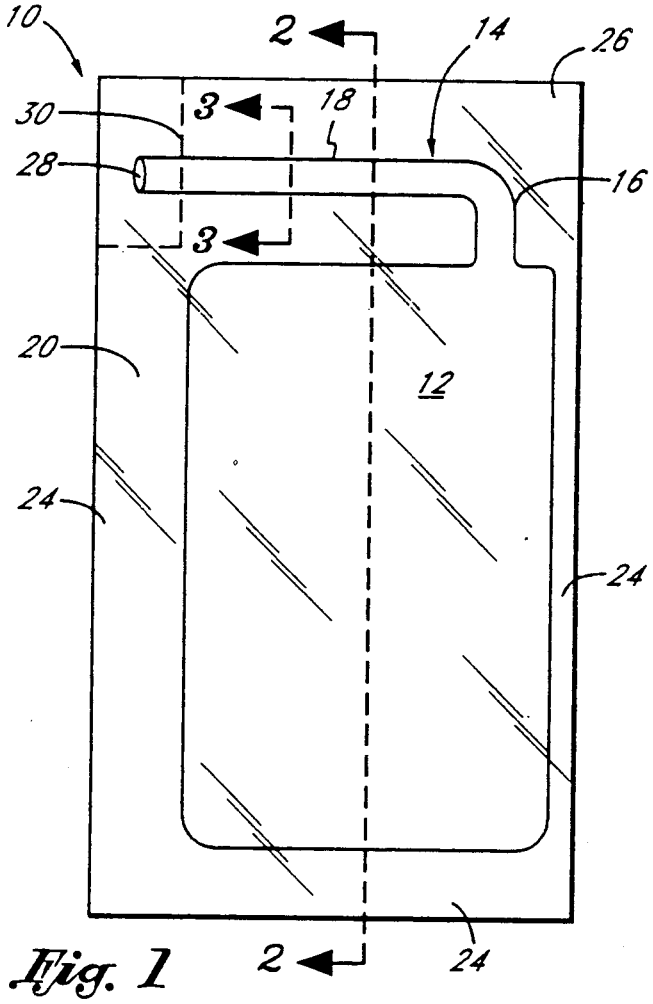
FIG. 1 is a plan view of the container of the present invention, illustrating the fluid reservoir and the exit flow channel.
Figure 2:
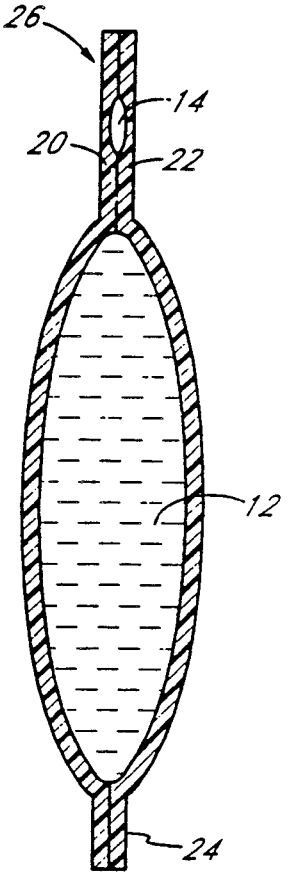
FIG. 2 is a side, cross-sectional view taken along line 2—2 of FIG. 1, showing the pouch-like shape of the fluid reservoir.

Referring to FIGS. 1 and 2, there is shown a flexible-sided container 10 embodying the principles of the present invention. The container includes a fluid reservoir 12 and an exit flow channel 14 comprising an upwardly extending member 16 and a horizontally extending member 18. However, it should be emphasized that these figures illustrate only a single container design and a single exit flow channel design, and that virtually an infinite number of container and channel designs are possible under the present invention.

The container 10 is constructed from two flexible, deformable sheets 20,22 which are sealed together on all four sides to form a boundary seal 24. The sheets 20,22 may be comprised of a wide variety of materials, such as a low density polyethylene, or a foil laminate having aluminum vacuum deposited onto polyester. One specific material is 12 $\mu$m PETP/metallic/70 $\mu$m PE; however, the principles of the present invention will apply to many flexible materials.

The boundary seal 24 of the container may be accomplished in any suitable fashion; for example, by heat sealing. In an alternate embodiment, a single sheet of material may be folded to form one boundary at the fold. The boundary seal 24 forms a reservoir 12 for containing fluids, which reservoir is pouch-shaped, as best illustrated in FIG. 2.

It will be noted in FIG. 1 that the upper boundary seal 26 is wider than the side boundary seals 24 in order to accommodate the exit flow channel 14. Again, it should be emphasized that the exit flow channel, as shown in FIG. 1, is for illustration purposes only, that the channel could be formed along the sides or bottom of the container, and that the container may take on various orientations in use. This is an important advantage of the present invention, which permits a wide flexibility in the design of the exit flow channel.

The exit flow channel 14 terminates at a distal end 28 in the boundary seal 24 of the container 10 near its outer edge. The width (W) of the exit flow channel 10 is shown in the cross-sectional illustration of FIG. 3. In its relaxed condition, the channel 14 is essentially that; although, it has been enlarged slightly in FIG. 3 for illustration. The length (L) of the channel 14 comprises the sum of the lengths of the vertical portion 16 and the horizontal portion 18, as shown in FIG. 1.

Figure 3:
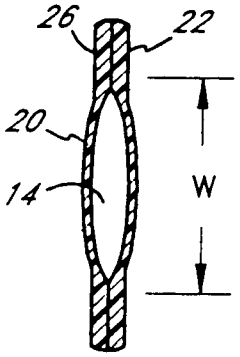
FIG. 3 is a cross-sectional view of the exit flow channel taken along line 3—3 of FIG. 1, illustrating the essentially flat, laminate construction of the exit flow channel.
Figure 4:
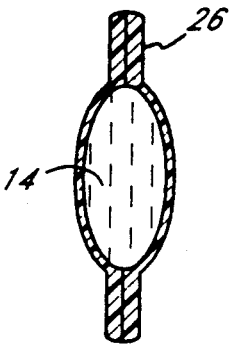
FIG. 4 is a cross-sectional view of the exit flow channel similar to FIG. 3, illustrating its essentially elliptical shape when pressure is applied to the container and fluid is forced out through the channel.

In operation, the user simply tears or cuts the boundary seal 24 of the container 10 near the distal end 28 of the exit flow channel 14, as indicated by the dotted line 30, in order to form an exit orifice. Manual or mechanical pressure is then applied to the container. Under pressure, the fluid is forced out of the reservoir 12 and through the exit flow channel 14, causing the channel 14 to enlarge and take on an approximately elliptical cross-section, as shown in FIG. 4. When the applied pressure is released or reduced sufficiently below a given critical pressure ($\Delta p_c$), the exit flow channel 14 automatically self-seals in order to prevent any further fluid flow. This self-sealing will be accomplished so long as the width and length of the exit flow channel 14 are designed in accordance with the principles of the present invention. Specifically, sealing is accomplished because the sides 20,22 of the channel 14 are drawn together again, in the essentially flat condition shown in FIG. 3. The width and length of the channel can be readily determined because of the relationships between three dimensionless multiparameters: the sealing parameter, the pressure parameter and the flow rate parameter.

Sealing Parameter (R)

The value of the sealing parameter (R) depends heavily on the characteristics of the fluid and its behavior in the exit flow channel 14. This parameter is critical because it influences the crossover point along the pressure differential curve between sealing and fluid flow. The fluid parameters encompassed within the sealing parameters are its surface tension ($\sigma$), and the wetting angle ($\alpha$) between the fluid and the innermost surface of the side of the container. It is often the surface tension which significantly affects the ability of the channel to self-seal. As pointed out above, the fluid should "wet" the surface such that $\alpha$ should be less than 90°.

Another component of the sealing parameter is the elasticity (k) of the material from which the container is constructed. This is not the general elasticity of the laminate sheet itself, but the elasticity of the wider sealed boundary 26 of the container in the vicinity of the exit flow channel 14. As illustrated in FIG. 4, the elasticity of the boundary seal 26 in the material surrounding the exit flow channel 14 tends to restore the channel to its relaxed condition, which is illustrated in FIG. 3. This elasticity constant (k) can be analogized to a mechanical spring and its associated spring constant. The springiness of this material acts essentially transverse to and along the entire length of the channel. The quantity (k) that appears herein is a spring constant per unit length of channel.

Figure 5:
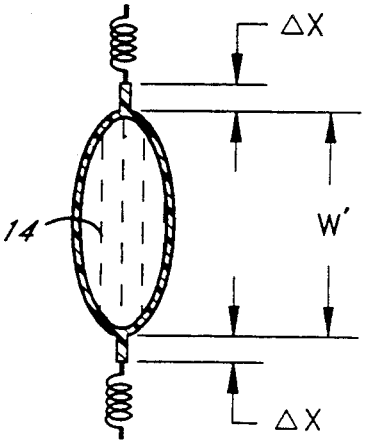
FIG. 5 is a schematic illustration of the cross-section of the exit flow channel, illustrating the elasticity of the container material surrounding the channel.

This spring analogy has been schematically illustrated in FIG. 5. In the pressurized condition, as pointed out above, the exit flow channel 14 takes on an essentially elliptical cross-section, wherein the ellipse has a semi-major axis "a" and a semi-minor axis "b." Because of the fluid pressure in the channel 14, the channel 14 forms an ellipse by opening vertically, thus shortening its width horizontally by a small distance $\Delta x$ on each side, as illustrated in FIG. 5. Thus, the new width W' of the exit flow channel equals 2*a*. The purely geometrical relation between a, the shortening of the channel with $\Delta x$, and the manufactured width of the channel (W) is:

$$W=2(a+\Delta x) \qquad \text{Eq. (1)}$$

The elasticity (or springiness) of the material is trying to restore the channel to its original width (W). This spring constant or elasticity parameter (k) governing this restoring force will generally be determined by measurement of specific materials in a given context. The key sealing parameter (R) is given by the following dimensionless combination:

$$R = \frac{\sigma \sin\alpha}{k\,W} \qquad \text{Eq. (2)}$$

R can be determined because of the interrelationships between the dimensionless multiparameters disclosed herein and as discussed in more detail below. If R is known, and if $\sigma$ and $\alpha$ are a function of the fluid characteristics, and if k can be measured, then the desired width (W) of the channel can be determined.

Even though this parameter presumes a Newtonian fluid (i.e., one describable by an ordinary viscosity), it will also provide a rough first approximation for the width (W) for non-Newtonian fluids. This parametrical relationship accommodates a wide variety of values of surface tension for the intended fluids. Values for surface tension for fluids such as water, ethyl alcohol, oleic acid and glycerin at 20° C. range from 30–75 g/sec$^2$. It should also be noted that small additions of surfactant chemicals can change the value of the surface tension, leading to variations in the sealing parameter R, thus affecting the self-sealability of the exit flow channel. In other words, if the value of the surface tension drops substantially, the value of the sealing parameter also drops, and this will result (as explained in more detail below) in a lower critical pressure at which self-sealing occurs.

As pointed out above, the value of the wetting angle may be obtainable from published sources; although, depending upon the fluid and the material lining the reservoir of the container, the wetting angle may have to be measured. Although the wetting angle plays a limited role in determining the sealing parameter (R) (unless it is close to 0°), it is essential that the fluid wets the liner of the pouch (i.e., $\alpha$ is less than 90°).

Pressure Parameter ($\Delta p/k$)

The pressure differential ($\Delta p$) for purposes of the present invention, is the difference between the pressure applied to the container (either manually or mechanically) in order to expel its contents and the ambient pressure surrounding the container (usually atmospheric pressure). More specifically, this pressure differential is the difference between ambient pressure and the pressure at the inlet orifice where the reservoir 12 joins the channel 14. Under some circumstances (for example, where the container is inverted), the applied pressure may include a pressure head generated by the column of fluid above the exit flow channel. In other situations, the applied pressure may also include an internal pressure caused, for example, by a carbonated beverage. In either case, the principles of the present invention accommodate such additional pressures since the pressure parameter focuses on the pressure differential. In the case of a carbonated beverage, most of the increased pressure applied during filling may be equilibrated by airflow upon initial opening of the exit orifice 28. The flow and sealing behavior of the container then follows the general outline for ordinary fluids as discussed herein.

The applied pressure will generally be known, since it is specified by the intended use of the container and its contents. For example, if the applied pressure is to be manually exerted, then it should fall within a convenient range which is suitable for human muscular ability. On the other hand, if the container and its contents are to be used in an industrial setting, a mechanical pressure much higher than manual pressure may be applied. The specified pressure range should include maximum and average pressure differentials.

Just as importantly, the application context of the container will dictate a critical sealing pressure ($\Delta p_c$), which will determine the highest pressure at which self-sealing will occur. In other words, any pressure differential exceeding $\Delta p_c$ will produce fluid flow, while any lower pressure differential will result in self-sealing. This relationship can be illustrated as follows:

$$\Delta p_c \leqq \Delta p_{ave} \leqq \Delta p_{max} \qquad \text{Ineq. (3)}$$

where $\Delta p_c$ is described above, pave is an average anticipated usage pressure differential, and $\Delta p_{max}$ is the maximum pressure to which the pouch is subjected (for example, dictated by the pressure at which the boundary seals 24 would rupture). The pressure differential ($\Delta p$) is a component of Poiseuille's Law, which is expressed as follows:

$$Q = \frac{\pi \Delta p\, a^3 b^3}{4\, \eta L\, a^2 + b^2} \qquad \text{Eq. (4)}$$

This equation expresses the flow rate (Q) in terms of various parameters, including Δp and a and b, which are directly proportional to the cross-sectional area and circumference of the pressurized, elliptical exit flow channel. This relationship suggests that the flow rate can be expressed in terms of the width (W) of the exit flow channel, thereby permitting the introduction of the relationship between the pressure differential, the width (W) and the elasticity parameter (k). W can be expressed as a function of the perimeter of an ellipse as follows:

$$W = 2aE \qquad \text{Eq. (5)}$$

where E is the complete elliptic integral of the second kind of the modulus m, and where $m = 1 - (b/a)^2$.

Thus, using Equations (4) and (5) and $m_1 = 1 - m$, the pressure differential can be expressed as a dimensionless pressure parameter as follows:

$$\frac{\Delta p}{k} = -\frac{2}{\pi} \frac{(E-1)\sqrt{m_1}\, E'}{E + 4m_1 E'} \qquad \text{Eq. (6)}$$

where $E' = dE/dm$. This is the general expression for the pressure differential in terms of the elasticity parameter (k) and the shape of the elliptical cross-section as described by m or $m_1$. However, it does not express the critical pressure differential at which sealing occurs. Sealing occurs when the pressures promoting sealing are equal to or greater than the pressure differential, as expressed above. The pressure promoting sealing is given by the following expression:

$$\Delta p = \frac{2W\sigma \sin \alpha}{\pi\, ab} \qquad \text{Eq. (7)}$$

Equating Δp in Equation (6) to Equation (7) (i.e., where the pressures promoting sealing equal the expulsion pressures) yields the value of R as follows:

$$R = -\frac{(E-1)\, m_1 E'}{4\, E^2 (E + 4m_1 E')} \qquad \text{Eq. (8)}$$

where R is given by Equation (2). Solving Equation (8) for the critical value of m, where sealing occurs, yields a value for the final unknown parameter. This value for m, when used in Equation (6) for Δp/k, yields a specific value of $\Delta p_c/k$, which is the critical sealing pressure scaled by k.

It should also be noted, in order to illustrate the relationship between these two parameters, the sealing parameter and the pressure parameter, that:

$$R = \frac{\pi \sqrt{m_1}}{8\, E^2} \frac{\Delta p_c}{k} \qquad \text{Eq. (9)}$$

The relationship expressed in this equation, (or, equivalently, Equations (6) and (P)) is, in turn, used to determine a value for R, which can then yield the width (W) of the exit flow channel in accordance with Equation (2).

As pointed out above, $\Delta p_c/k$ will usually be determined by the application. Because it is a ratio of specific parameters, there is built into this relationship quite a bit of design flexibility. In other words, if $\Delta p_c$ is varied according to the application specifications, self-sealing can still be accomplished by properly varying or adjusting k so that the ratio of the two is suitable.

Flow Rate Parameter (q)

Poiseuille's Law, as set forth in Equation (4), can also be expressed as a dimensionless flow rate, as follows:

$$q = \frac{\eta L Q}{k W^4} \qquad \text{Eq. (10)}$$

This is the expression for the third dimensionless multiparameter, the flow rate parameter (q). Although this parameter is not given directly by the design, it is impacted substantially by the application in terms of the dimensional flow rate (Q). In other words, in any particular application, a desirable flow rate can be specified as follows:

$$0 \leqq Q_{ave} \leqq Q_{max} \qquad \text{Ineq. (11)}$$

In other words, in any particular application, a desirable flow rate, or a range of flow rates, can be specified. The application will typically determine an average or optimal value for the flow rate, $Q_{ave}$, and a maximum flow rate $Q_{max}$. This flow rate parameter can also accommodate a wide range of fluid viscosities, which may range from 0.01 poise for water (at 20° C.) to 15 poise for glycerin (again at 20° C.).

The dimensionless flow rate parameter (q) can be expressed in terms of the cross-sectional geometry of the exit flow channel as follows:

$$q = -\frac{1}{32} \frac{(E-1) m_1^2 E'}{E^4 (1 + m_1)(E + 4m_1 E')} \qquad \text{Eq. (12)}$$

which expresses q in terms of m and $m_1$. Once m has been determined for a given critical pressure differential, the relationship between the flow and pressure differential is given parametrically by Equations (6) and (12), the parameter being m, which gives the cross-sectional shape of the channel. This substitution of values then accomplishes the basic mathematical interrelationships among the three dimensionless groups of parameters governing the operation of the device: sealing parameter (R), the pressure parameter (Δp/k) and the flow rate parameter (q).

Assuming, then, that the value for q can be determined from these interrelationships, that the viscosity (η) of the fluid is known, as well as the width (W), elasticity (k), and desired flow rate (Q), Equation (10) can then be solved for the desired length (L) of the exit flow channel, at which the desired flow rate can be achieved.

It should be noted that Equations (6), (8) and (12) express the three dimensionless factors (R, Δp/k, and q) in terms of the modulus m of the elliptical approximation of the cross-section of the exit flow channel, and, more particularly, the convenient expression for m, $m_1$. Since m can only vary between zero and 1, the relationships expressed in these equations show that a table can be created for the sealing, pressure and flow rate parameters to facilitate the determination of the width (W)

and length (L) of the exit flow channel. Such a table is set forth below for the indicated range of m:

TABLE 1

Derived from Equations 6, 8 and 12 For A Complete Range of Values of m

| m | R | $\Delta p/k$ | q |
|---|---|---|---|
| .02 | 1.887 | 11.854 | 0.0253 |
| .04 | 0.923 | 5.799 | 0.0253 |
| .06 | 0.601 | 3.781 | 0.0253 |
| .08 | 0.441 | 2.771 | 0.0253 |
| .10 | 0.344 | 2.166 | 0.0253 |
| .12 | 0.280 | 1.762 | 0.0252 |
| .14 | 0.234 | 1.474 | 0.0252 |
| .16 | 0.200 | 1.258 | 0.0252 |
| .18 | 0.173 | 1.090 | 0.0251 |
| .20 | 0.151 | 0.955 | 0.0251 |
| .22 | 0.134 | 0.845 | 0.0250 |
| .24 | 0.119 | 0.754 | 0.0249 |
| .26 | 0.107 | 0.676 | 0.0248 |
| .28 | 0.096 | 0.610 | 0.0247 |
| .30 | 0.087 | 0.552 | 0.0246 |
| .32 | 0.079 | 0.502 | 0.0245 |
| .34 | 0.072 | 0.458 | 0.0244 |
| .36 | 0.065 | 0.418 | 0.0243 |
| .38 | 0.060 | 0.383 | 0.0241 |
| .40 | 0.055 | 0.351 | 0.0239 |
| .42 | 0.050 | 0.323 | 0.0238 |
| .44 | 0.046 | 0.297 | 0.0236 |
| .46 | 0.042 | 0.273 | 0.0233 |
| .48 | 0.038 | 0.251 | 0.0231 |
| .50 | 0.035 | 0.231 | 0.0228 |
| .52 | 0.032 | 0.213 | 0.0226 |
| .54 | 0.029 | 0.196 | 0.0223 |
| .56 | 0.027 | 0.180 | 0.0219 |
| .58 | 0.025 | 0.165 | 0.0216 |
| .60 | 0.022 | 0.152 | 0.0212 |
| .62 | 0.020 | 0.139 | 0.0208 |
| .64 | 0.018 | 0.127 | 0.0203 |
| .66 | 0.017 | 0.116 | 0.0198 |
| .68 | 0.015 | 0.105 | 0.0193 |
| .70 | 0.013 | 0.095 | 0.0187 |
| .72 | 0.012 | 0.086 | 0.0181 |
| .74 | 0.010 | 0.077 | 0.0174 |
| .76 | 0.009 | 0.069 | 0.0167 |
| .78 | 0.008 | 0.061 | 0.0159 |
| .80 | 0.0068 | 0.054 | 0.0150 |
| .82 | 0.0057 | 0.047 | 0.0141 |
| .84 | 0.0047 | 0.040 | 0.0130 |
| .86 | 0.0038 | 0.034 | 0.0119 |
| .88 | 0.0030 | 0.028 | 0.0107 |
| .90 | 0.0023 | 0.022 | 0.0093 |
| .92 | 0.0016 | 0.017 | 0.0078 |
| .94 | 0.0010 | 0.012 | 0.0062 |
| .96 | 0.0005 | 0.007 | 0.0044 |
| .98 | 0.0002 | 0.003 | 0.0023 |

It is a simple matter to obtain more detailed coverage for any range of parameters in this table. It might also be noted that the title of the third column is simply $\Delta p/k$. This is because, depending upon the parameter value sought, $\Delta p$ might be $\Delta p_c$ or $\Delta p_{ave}$. For example, if trying to determine the width (W) of the channel by means of R, the desired value of $\Delta p_c$ is used for the pressure parameter $\Delta p_c/k$. For a $\Delta p_c/k$ at 0.323, the corresponding sealing parameter (R) for achieving a self-seal is 0.050. However, if trying to determine the length of the channel by means of q, the desired value of $\Delta p_{ave}$ is used. For a $\Delta p_{ave}/k$ of 0.273, the corresponding flow rate parameter (q) is 0.0233. From these values of R and q, the width and length of the exit flow channel can be readily determined in accordance with Equations (2) and (10), respectively.

It is important to observe that the present container design is quite independent of overall exit flow channel geometry, except for the specific parameters of width and length. This analysis takes into consideration the fluid dynamics in the exit flow channel, which comprises a deformable tube. In other words, the self-sealing action is retained in a flow regime in which the cross-sectional area of the exit flow channel is constantly changing as a function of the applied pressure differential.

Design Methodology

Table 1 and the relationships for the sealing, pressure and flow rate parameters expressed above provide a unique process for determining the width and length of an exit flow channel which will automatically achieve self-sealing. The first step of that process is to determine the context in which the container and its fluid contents will be utilized. Thus, information on the viscosity ($\eta$) and surface tension ($\sigma$) of the fluid at temperatures for which the container will be utilized should be gathered. It should be pointed out, however, that changes in temperature while the container is in use should not have a significant affect on the ability of the container to self-seal, since the relationships expressed above are not highly temperature dependent. Furthermore, information on the desired material, design of the container, the intended audience, serving size and desired dispensing rate should be gathered. This information is necessary in order to determine (in accordance with (3)) a critical pressure differential ($\Delta p_c$) at which self-sealing will be accomplished and a reasonable range of pressures for flow operation of the container. Also, in accordance with (11), a desired range of flow rates should be determined, and, in particular, an average flow rate, $Q_{ave}$. The wetting angle ($\alpha$) should be measured or otherwise determined in connection with the material chosen for the container. Furthermore, the elasticity constant (k) should also be measured or otherwise determined for the material in the vicinity of the exit flow channel.

From this information, then, $\Delta p_c/k$ can be easily obtained. Utilizing Table 1, the corresponding value of R can be read in the second column. Using Equation (2), all variables are now known except the width (W) for which the equation can be easily solved. This value thus yields the desirable width of the exit flow channel at which self-sealing is accomplished.

A new pressure parameter is not calculated, this time using $\Delta p_{ave}$, rather than $\Delta p_c$. Thus, referring to Table 1, $\Delta p_{ave}/k$ yields a corresponding value of $q_{ave}$, where $q_{ave}$ is the dimensionless average flow rate for the optimal container. This $q_{ave}$ is determined by the table. Solving Equation (10) for L yields:

$$L = \frac{q_{ave}\, k\, W^4}{\eta\, Q_{ave}} \qquad \text{Eq. (13)}$$

Since all of these variables except the length (L) are now known, the optimal length of the exit flow channel, in order to accomplish the desired average flow rate, can be easily determined. In addition, there is some flexibility in designing L, while at the same time achieving self-sealing.

Advantageously, the width and length of the exit flow channel, which are sufficient to accomplish self-sealing, can then be embodied in any conceptual design of the container and in any container or flow channel orientation. This is a major improvement over the deformable containers of the prior art. In other words, width and length are independent of the path of the exit flow channel and other complex channel geometry. This is partially illustrated by FIGS. 6–8 which depict just a few of the almost infinite number of container designs and exit flow channel paths that are possible. Many other designs are possible, depending upon the application.

Figure 6:
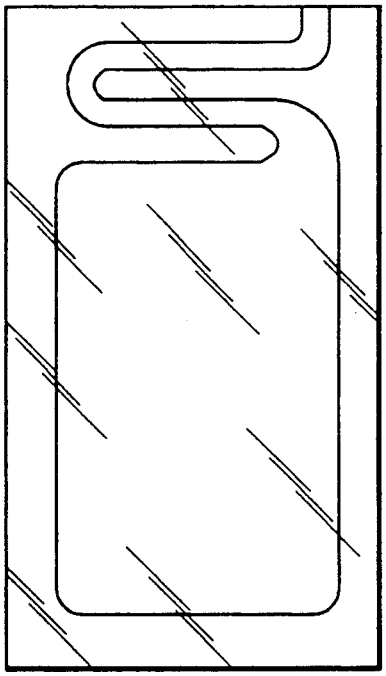
FIGS. 6–8 are illustrations of containers similar to FIG. 1, showing just a few exemplary exit flow channel designs from the wide variety of designs capable with the principles of the present invention.
Figure 7:
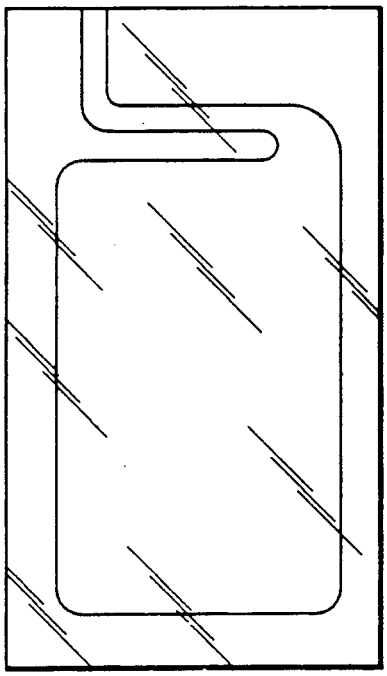
Figure 8:
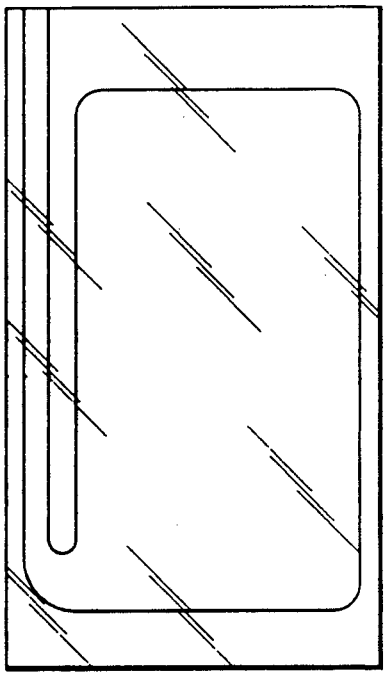

It should be pointed out, in connection with FIGS. 6–8, that the ability of the container in the present invention to self-seal is, in reality, independent of the length of the exit flow channel. This is evident from Equation (2) in which the sealing parameter (R) is proportional to the width (W) of the exit flow channel, and is not related to the length (L). As pointed out above, this concept and the specific relationship expressed in Equation (2) represents a significant advancement over the pouches of the prior art, which taught that the exit flow channel must follow a specific, usually circuitous path in order to self-seal. However, as illustrated by the relationship expressed in Equation (13), the length of the exit flow channel of the present container cannot be independently designed, since the length is proportional to the width of the channel to the fourth power. Thus, these two parameters must be considered together; otherwise, the length of the channel might be unreasonably short or long. In other words, the length and width of the channel are dependent upon one another if both optimal conditions of the container of the present invention are to be met: (i) the desired average flow rate is achieved for the specified pressure range, and (ii) the exit flow channel self-seals automatically when the applied pressure falls below the specified pressure range. Again, it is apparent that the prior art has not considered both of these conditions simultaneously, as in the present analysis.

It should be pointed out, in developing the present container design, that two states of fluid flow have been considered, i.e., no flow, which occurs after self-sealing, and steady flow, when the fluid flow is fully developed. There exists, of course, many intermediate flow regimes between these two ideal conditions where the flow may pulsate or otherwise not exhibit steady characteristics due to insufficient applied pressure. It is very difficult to describe in a quantitative manner the parameters which exist during these intermediate flow regimes; however, the key parameters and their interrelationships, which exist during the two ideal flow states described above, have been identified herein.

It will be noted from Table 1 that the values of q vary little at the upper ranges. Thus, it has been discovered that the value for the sealing parameter (R) should usually be kept below about 0.050, in order to provide flexibility in width and length design. It has also been found that these relationships permit a comprehensive understanding of design scaling. For example, if an exit flow channel design is found to be acceptable for a given container material and fluid (of viscosity $\eta$ and surface tension $\sigma$), and it is then desirable to utilize essentially the same design with a second fluid (or viscosity $\eta'$ and surface tension $\sigma'$), the width of the exit flow channel in the container for the second fluid can be approximated by using the ratio $\sigma/W=\sigma'/W'$. This relation follows from a desire to keep R the same and the assumption that $\alpha$ and $\alpha'$ are approximately the same. Then, approximately the same applied pressure is required to start the flow and the critical pressure to achieve self-sealing remains the same. Assuming that the second container is simply a scaled version of the first, the elasticity constant (k) remains the same. However, the relationships given above show that this scaling may not be suitable in all cases since the flow rate in the second container will vary with the cube of the ratio of the surface tensions, as expressed as follows:

$$Q^1 = Q\left(\frac{\eta}{\eta'}\right)\left(\frac{\sigma'}{\sigma}\right)^3 \qquad \text{Eq. (14)}$$

In other words, if there is a substantial change in the ratio of $\sigma$ to $\sigma'$ (in the second container), then the design may be unacceptable because the flow rate will be unacceptable.

In conclusion, it is believed that the flexible container of the present invention, together with the method for designing it, presents a significant advancement over the prior art. The present invention permits almost infinite flexibility in container orientation and exit flow channel path, while maintaining extremely low manufacturing costs.

What is claimed is:

1. A container for fluids, comprising:

a reservoir formed by said container for holding a fluid; and an exit flow channel joined to said reservoir at an inlet orifice formed by a deformable material for expelling said fluid from said reservoir when a pressure is applied to said container, said exit flow channel (i) permitting the flow of fluid when said applied pressure is above a predetermined level, and (ii) preventing the flow of fluid when said applied pressure is below said predetermined level, said exit flow channel having a width (W), wherein $$W = \frac{\sigma \sin\alpha}{kR}$$

wherein:

$\sigma$=the surface tension for the fluid $\alpha$=the wetting angle of the fluid on the material in question k=the elasticity constant for said material R=the sealing parameter corresponding to the critical pressure differential below which the channel accomplishes self-sealing divided by k and said exit flow channel having a length (L), wherein $$L = \frac{q_{ave}\, k W^4}{\eta\, Q_{ave}}$$

wherein:

$q_{ave}$=the flow rate parameter corresponding to an applied pressure differential divided by k, wherein said applied pressure differential equals the difference between outside, ambient pressure and the pressure at said inlet orifice k=the elasticity constant for said material W=the width of said exit flow channel $\eta$=the viscosity of said fluid $Q_{ave}$=the flow rate of said fluid in response to said applied pressure differential.

* * * * *